US010519534B2

(12) United States Patent
Okabe et al.

(10) Patent No.: US 10,519,534 B2
(45) Date of Patent: Dec. 31, 2019

(54) IRON-BASED AMORPHOUS ALLOY THIN STRIP

(71) Applicant: JFE Steel Corporation, Tokyo (JP)

(72) Inventors: Seiji Okabe, Tokyo (JP); Nobuo Shiga, Tokyo (JP); Takeshi Imamura, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 491 days.

(21) Appl. No.: 14/907,868

(22) PCT Filed: Jul. 28, 2014

(86) PCT No.: PCT/JP2014/069775

§ 371 (c)(1),
(2) Date: Jan. 27, 2016

(87) PCT Pub. No.: WO2015/016161

PCT Pub. Date: Feb. 5, 2015

(65) Prior Publication Data

US 2016/0168674 A1 Jun. 16, 2016

(30) Foreign Application Priority Data

Jul. 30, 2013 (JP) ..... 2013-157261

(51) Int. Cl.

| | |
|---|---|
| ***C22C 45/02*** | (2006.01) |
| ***H01F 1/153*** | (2006.01) |
| ***H01F 27/25*** | (2006.01) |

(52) U.S. Cl.
CPC ..... *C22C 45/02* (2013.01); *H01F 1/15308* (2013.01); *H01F 27/25* (2013.01)

(58) Field of Classification Search
None
See application file for complete search history.

(56) References Cited

U.S. PATENT DOCUMENTS

| | | | |
|---|---|---|---|
| 4,588,015 | A | 5/1986 | Liebermann |
| 4,660,622 | A | 4/1987 | Reutler et al. |
| 5,370,749 | A | 12/1994 | Ames et al. |

(Continued)

FOREIGN PATENT DOCUMENTS

| | | |
|---|---|---|
| CN | 101800109 | 8/2010 |
| CN | 101840764 | 9/2010 |

(Continued)

OTHER PUBLICATIONS

Translation of JP 2000-054089 (published Feb. 22, 2000) from J-Plat Pat.*

(Continued)

*Primary Examiner* — George Wyszomierski
(74) *Attorney, Agent, or Firm* — DLA Piper LLP (US)

(57) ABSTRACT

A iron-based amorphous alloy thin strip having a chemical composition represented by a chemical formula of $Fe_xB_ySi_z$ (wherein x is 78-83 at %, y is 8-15 at % and z is 6-13 at %), wherein the number of air pockets at a surface contacting with a cooling roll is not more than 8 pockets/mm$^2$ and an average length in a circumferential direction of the roll is not more than 0.5 mm.

8 Claims, 1 Drawing Sheet

(56) References Cited

U.S. PATENT DOCUMENTS

| | | | | |
|---|---|---|---|---|
| 5,658,397 | A * | 8/1997 | Kogiku | H01F 1/15308 148/304 |
| 5,875,065 | A | 2/1999 | Shimura | |
| 6,273,967 | B1 * | 8/2001 | Matsuki | B22D 11/06 148/304 |
| 6,425,960 | B1 * | 7/2002 | Yoshizawa | H01F 1/15308 148/121 |
| 2004/0140016 | A1 * | 7/2004 | Sakamoto | C22C 33/003 148/304 |
| 2010/0097171 | A1 | 4/2010 | Urata et al. | |
| 2013/0314198 | A1 | 11/2013 | Yoshizawa et al. | |

FOREIGN PATENT DOCUMENTS

| | | | |
|---|---|---|---|
| GB | 2 023 173 | A | 12/1979 |
| JP | 54-148122 | A | 11/1979 |
| JP | 55-94460 | A | 7/1980 |
| JP | 57-137451 | A | 8/1982 |
| JP | 58-000358 | A | 1/1983 |
| JP | 60-228648 | A | 11/1985 |
| JP | 06-269907 | A | 9/1994 |
| JP | 07-331396 | | 12/1995 |
| JP | 09-143640 | | 6/1997 |
| JP | 2000-054089 | A | 2/2000 |
| JP | 2000-328206 | | 11/2000 |
| JP | 2002-205148 | A | 7/2002 |
| KR | 1994-0011764 | | 12/1994 |
| TW | 200903534 | A | 1/2009 |
| WO | 87/06166 | | 10/1987 |
| WO | 2012/102379 | | 2/2012 |

OTHER PUBLICATIONS

Japanese Office Action dated Jun. 8, 2016, of corresponding Japanese Application No. 2015-529557, along with a Concise Statement of Relevance of Office Action in English.

Office Action issued for corresponding Taiwanese Application No. 103125859 with English translation dated Jun. 11, 2015.

Korean Office Action dated Jan. 31, 2017, of corresponding Korean Application No. 10-2016-7000828, along with a Concise Statement of Relevance of Office Action in English.

Japanese Office Action dated Jan. 18, 2017, of corresponding Japanese Application No. 2015-529557, along with a Concise Statement of Relevance of Office Action in English.

Chinese Office Action dated Aug. 31, 2016, of corresponding Chinese Application No. 201480038977.0, along with a Search Report in English.

Request dated Jun. 15, 2018, to Cancel Korean Patent No. 1848725 along with a Concise Statement of Relevance of Office Action in English.

* cited by examiner

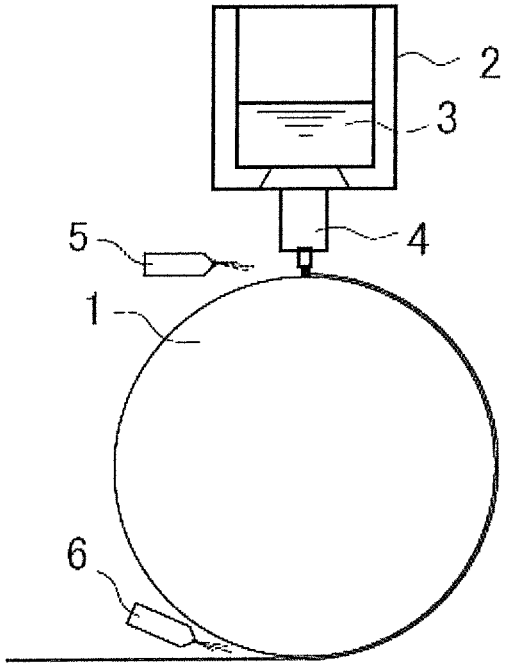
2
3
4
5
1
6

IRON-BASED AMORPHOUS ALLOY THIN STRIP

TECHNICAL FIELD

This disclosure relates to an iron-based amorphous alloy thin strip suitable for use in a core material of a wound iron-core transformer and more particularly to a high magnetic flux density and low iron loss Fe—B—Si based amorphous alloy thin strip.

BACKGROUND

As an iron core of a distribution transformer or the like may be used a wound iron core using a Fe—B—Si-based amorphous alloy thin strip. As a material used for the wound iron core, for example, JP-A-554-148122, JP-A-555-094460 and JP-A-557-137451 disclose an amorphous alloy thin strip with a thickness of several tens μm prepared by injecting a iron-based molten alloy based on Fe and added with B, Si and the like onto a surface of a high-speed rotating cooling roll to perform rapid solidification.

The Fe—B—Si-based amorphous alloy thin strip has a feature that an iron loss is low compared to a grain-oriented electrical steel sheet prepared by utilizing conventional secondary recrystallization, but is low in the saturated magnetic flux density. Hence, a design magnetic flux density must be decreased so that there are such problems that the transformer is made large and a greater amount of copper wire for the coil is required.

Therefore, a technique of increasing a ratio of Fe content in an amorphous alloy to enhance a saturated magnetic flux density to thereby make a design magnetic flux density large is developed, which provides a certain improvement effect. However, since the alloy having a higher ratio of Fe content lowers an amorphous stability, it is difficult to stably provide a low iron loss. Also, there is a problem that iron loss measured at a wound iron core state is increased compared to iron loss measured on a raw steel material, that is, a so-called "building factor" is large.

It could therefore be helpful to provide a Fe—B—Si-based amorphous alloy thin strip capable of stably providing a high magnetic flux density and low iron loss wound iron core.

SUMMARY

We found that when the surface property of a thin strip is controlled in the Fe—B—Si-based amorphous alloy thin strip, the increase in iron loss in the working to a wound iron core can be suppressed while maintaining a high magnetic flux density.

We thus provide an iron-based amorphous alloy thin strip having a chemical composition represented by a chemical formula of $Fe_xB_ySi_z$ (wherein x is 78-83 at %, y is 8-15 at % and z is 6-13 at %) wherein the number of air pockets at a surface contacting with a cooling roll is not more than 8 pockets/$cm^2$ and an average length in a circumferential direction of the roll is not more than 0.5 mm.

The iron-based amorphous alloy thin strip contains one or two of Cr: 0.2-1 at % and Mn: 0.2-2 at % in addition to the above chemical composition.

Also, the iron-based amorphous alloy thin strip contains one or more of C: 0.2-2 at %, P: 0.2-2 at %, Sn: 0.2-1 at % and Sb: 0.2-1 at % in addition to the above chemical composition.

Further, the iron-based amorphous alloy thin strip can be used for a wound iron-core transformer.

There can be provided an iron-based amorphous alloy thin strip having a high magnetic flux density and an excellent iron loss property in the working to a wound iron core so that it is possible to stably manufacture a low-iron loss transformer.

BRIEF DESCRIPTION OF THE DRAWING

FIG. 1 is a schematic view explaining a method of injecting a molten alloy to produce a rapidly cooled amorphous thin strip with a single roll-type rapid cooling apparatus for producing a thin strip.

DESCRIPTION OF REFERENCE SYMBOLS

1: cooling roll
2: molten iron container
3: molten alloy
4: nozzle
5: nozzle for adjustment of casting atmosphere
6: air slit nozzle
S: amorphous thin strip

DETAILED DESCRIPTION

At first, experiments describing development of our thin strips will be described.

A molten alloy having a chemical composition of Fe: 80 at %, B: 10 at %, Si: 9 at % and C: 0.5 at % is injected onto a surface of a single roll-type copper cooling roll rotating at a high speed and rapidly solidified into an iron-based amorphous alloy thin strip having a thickness of 25 μm and a width of 100 mm, which is wound in a form of a coil. In this case, the surface properties of the cooling roll and the atmosphere in the injection of the molten alloy are changed variously.

The thus obtained alloy thin strip is wound on a bobbin of vitreous silica having a diameter of 200 mmϕ and a width of 105 mm to form a toroidal core having a weight of 2 kg. Three toroidal cores are prepared from the alloy thin strip manufactured under the same conditions. These cores are subjected to an annealing at temperatures of 360° C., 380° C. and 400° C. at a state of applying a magnetic field of 1600 A/m and in a nitrogen atmosphere, respectively.

Thereafter, a primary coil and a secondary coil are wound onto the core after annealing and magnetized by alternating current under conditions of 1.3 T and 50 Hz to measure an iron loss $W_{13/50}$ of the core. In the measurement of the iron loss, since sticking may be caused between the strips by the annealing to increase the iron loss, "removal of sticking" by applying a shock to the core to clear the sticking state is repeatedly performed, and an iron loss value at an annealing temperature indicating a lowest iron loss is adopted as an iron loss value of the alloy.

In the iron loss values of the toroidal cores measured as mentioned above, a big scattering is caused even though they are prepared from the alloy thin strips of the same composition, thickness and width. As surfaces of the thin strip having a large iron loss and the thin strip having a small iron loss contacted with the cooling roll are observed, many recesses exist on the surface of the thin strip having the large iron loss, and most of recesses lengthwise extend in a casting direction (circumferential direction of the roll) are especially observed. Such recesses are formed by catching atmosphere gas between the molten alloy and the surface of the cooling roll, which is a so-called "air pocket." It is known that the number of the recesses formed and the shape thereof are different in accordance with the surface property and surface temperature of the cooling roll, the atmosphere and the like.

The number of air pockets generated per unit area and an average length thereof in the circumferential direction of the roll are measured by photographing the surface of the thin strip at a side contacting with the cooling roll by an optical microscope at a magnification of 20 times. Also, arithmetic mean roughness Ra as an indicator conventionally showing a preferable surface property and an area ratio of the air pocket are examined for comparison. As a result, we found that even when the Ra and air pocket area ratio are substantially the same, the iron loss property is poor when the number of the air pockets generated per unit area is large or when the air pocket becomes large in the circumferential direction of the roll.

Further, we examined the influence of the chemical composition of an iron-based amorphous alloy upon magnetic properties of a wound iron core by performing the same experiment as mentioned above while melting an alloy having a chemical composition formed by changing a composition of Fe, B and Si and variously changing addition ranges of Cr, Mn and other elements. As a result, we found that iron-based amorphous alloy thin strips having a high magnetic flux density and an excellent iron loss property of wound iron core can be obtained by controlling the chemical composition of the Fe—B—Si-based amorphous alloy as mentioned later in addition to controlling the surface property.

First, the iron-based amorphous alloy thin strip is necessary to have a chemical composition represented by a chemical formula of $Fe_xB_ySi_z$ (wherein x is 78-83 at %, y is 8-15 at % and z is 6-13 at %).

Fe: 78-83 at %

Fe is a base ingredient of the Fe—B—Si-based amorphous alloy. When it is less than 78 at %, the magnetic flux density becomes too low, while when it exceeds 83 at %, the amorphous stability and the iron loss property are deteriorated. Therefore, Fe is present in an amount of 78-83 at %. Preferably, it is 80-82 at %.

B: 8-15 at %

B is an element required to make the alloy amorphous. When it is less than 8 at %, the stable amorphous formation is difficult. While when it exceeds 15 at %, the magnetic flux density is decreased, but also the increase of the raw material cost is caused. Therefore, B is present in an amount of 8-15 at %. Preferably, it is 9-13 at %.

Si: 6-13 at %

Si is an element required for the decrease of iron loss and amorphous formation. When it is less than 6 at %, the iron loss is increased or the amorphous formation becomes unstable. While when it exceeds 13 at %, the magnetic flux density is decreased largely. Therefore, Si is present in an amount of 6-13 at %. Preferably, it is 7-11 at %.

For the purpose of enhancing the effect of improving the iron loss in the iron-based amorphous alloy thin strip, one or two selected from Cr: 0.2-1 at % and Mn: 0.2-2 at % may be added in a total or per the whole of the alloy in addition to the above fundamental chemical composition.

Cr and Mn have an effect of decreasing the iron loss of the wound iron core so that it is preferable to add each of them in an amount of not less than 0.2 at %. In the thin strip being less in the number of air pockets, contact area between the strips in the winding as a core becomes larger so that sticking (adhesion) is easily caused in annealing the core. We found that sticking is mitigated by adding these elements.

Although the cause is not still clear, these elements are enriched into an oxide film on the surface of the thin strip and have an effect of enhancing the protection of the oxide film. As a result, we believe that sticking is suppressed to decrease the number of adhered portions, thereby deteriorating the iron loss and also the application of shock to remove the sticking becomes light to suppress deterioration of the iron loss due to the shock. However, when Cr is added in an amount exceeding 1 at % and Mn is added in an amount exceeding 2 at %, the magnetic flux density is lowered. Therefore, it is preferable that Cr is added in an amount of 0.2-1 at % and Mn is added in an amount of 0.2-2 at %. More preferably, Cr is 0.2-0.7 at % and Mn is 0.2-1 at %.

Furthermore, the iron-based amorphous alloy thin strip can contain one or more of the following ingredients in a total (per the whole of the alloy) to the above chemical composition.

C: 0.2-2 at %, P: 0.2-2 at %

C and P have an effect of stabilizing amorphous formation in a component system having a large Fe ratio. To obtain such an effect, it is preferable to add each of them in an amount of not less than 0.2 at %. While when each of them is added in an amount exceeding 2 at %, the magnetic flux density is lowered so that the each upper limit is preferable to be 2 at %. More preferably, C is 0.8-2 at % and P is 0.8-2 at %.

Sn: 0.2-1 at %, Sb: 0.2-1 at %

Sn and Sb have an effect of decreasing the iron loss in a component system having a large Fe ratio. To obtain such an effect, it is preferable to add each of them in an amount of not less than 0.2 at %. We confirmed that these elements have an effect of suppressing crystallization of amorphous portion at a surface side of the thin strip contacted with the cooling roll in the annealing after formation of the core, which is believed to bring about the effect of suppressing the increase of the iron loss. However, when each of Sn and Sb is added in an amount exceeding 1 at %, the iron loss is increased so that the upper limit is preferable to be 1 at %, respectively. More preferably, Sn is in an amount of 0.2-0.7 at % and Sb is in an amount of 0.2-0.7 at %.

The remainder other than the above ingredients is inevitable impurities. However, Co and Ni have an effect of slightly increasing the magnetic flux density and are small in the influence on the productivity and iron loss so that it is possible to include them in an amount of not more than 2 at %.

The surface property of the iron-based amorphous alloy thin strip will be described below.

Number of Air Pockets: Not More than 8 Pockets Per 1 $mm^2$

Air pockets existing on the surface of the thin strip at a side contacting with the cooling roll obstruct the transfer of heat to the cooling roll, and become unstable in the amorphous formation and form partially crystallized portions. Also, the air pocket suppresses the movement of magnetic wall due to the pinning effect, and thus the air pocket deteriorates the iron loss of the thin strip. Especially, the air pocket is large in the effect of pinning the movement of magnetic walls. In the wound iron core, when non-uniform surface shape such as air pocket is existent in the thin strip, if stress is applied from an exterior of the iron core, bending stress is concentrated in the air pocket portion to bring about the increase of the iron loss.

Therefore, the number of air pockets is preferably smaller. We attempted to improve the iron loss in the wound iron core by decreasing the number of air pockets formed on the surface of the thin strip contacted with the cooling roll to not more than 8 pockets/mm$^2$. The reason why the number of air pockets is decreased to not more than 8 pockets/mm$^2$ is due to the fact that when it exceeds 8 pockets/mm$^2$, the iron loss is violently increased as shown in the following examples. Preferably, it is not more than 5 pockets/mm$^2$.

Average Length of Air Pocket: Not More than 0.5 mm

The air pocket is large in the action of deteriorating the iron loss as it becomes longer in the casting direction of the thin strip (circumferential direction of the roll). This is believed to be due to the fact that the pinning effect to the movement of magnetic wall extending in a longitudinal direction is large. Therefore, the iron loss property in the wound iron core is improved by restricting the average length of the air pocket in the casting direction (rotating direction of the roll) to not more than 0.5 mm.

As shown in the following examples, when the average length of the air pocket in the circumferential direction of the roll exceeds 0.5 mm, the iron loss is violently increased. Preferably, it is not more than 0.3 mm.

The number and the average length of the air pockets is determined as described below. First, a surface of the thin strip at a side contacting with a cooling roll is photographed with an optical microscope at a magnification of about 20 times, from which are measured the number of air pockets generated on the surface of the thin strip per an area of 10 mm square and a length of the each air pocket in a circumferential direction of the roll to obtain average values. Such measurement is conducted over the whole width of the thin strip at an interval of 20 mm in the widthwise direction, and average values thereof are determined to be the number and an average length of air pockets of the thin strip.

When the thin strip has a narrow width of not more than about 50 mm, generation of air pockets may be prevented by performing the production under vacuum. However, when a thin strip having a wide width of not less than 100 mm used for a transformer or the like for power generation is produced, a large vacuum equipment is required, which is impractical. To this end, it is necessary to restrict the number and form of the inevitably formed air pockets.

The production method of the iron-based amorphous alloy thin strip will be described below.

The iron-based amorphous alloy thin strip is obtained by solidifying a molten alloy having an adjusted chemical composition as mentioned above through rapid cooling. For example, there can be used a general method of producing a thin strip by injecting a molten alloy 3 onto a surface of a water-cooled copper or copper alloy cooling roll rotating at a high speed through a slit-shaped nozzle 4 formed in a molten iron container 2, rapidly solidifying and peeling it from the cooling roll 1 with an air slit nozzle 6 to obtain an amorphous thin strip S as shown in FIG. 1.

Moreover, the surface roughness of the cooling roll for rapidly solidifying the molten alloy is preferable to be smaller from a viewpoint of decreasing the number and size of the air pockets on the surface of the thin strip. Concretely, the arithmetic mean roughness Ra defined in JIS B0601-2001 is preferably not more than 10 μm, more preferably not more than 1 μm.

Also, the surface temperature of the cooling roll is preferably heated to a temperature of 80-200° C. from a viewpoint of decreasing the number and size of the air pockets on the surface of the thin strip. When the surface temperature is lower than 80° C., the wettability of the molten alloy is deteriorated, while when it exceeds 200° C., the rapid cooling effect is not obtained.

Furthermore, foreign matter attached to the surface of the cooling roll is liable to form streaky flaws extending in the circumferential direction of the roll on the surface of the thin strip. The flaws are a cause of generating long air pockets. In the production of the thin strip, therefore, it is desirable to remove dust from the periphery of the cooling roll or adopt on-line polishing to the surface of the cooling roll.

Moreover, an atmosphere in the rapid solidification of the molten alloy is preferable to be $CO_2$ gas or burned CO gas ($CO+CO_2$). This is because it is difficult to decrease the number and size of the air pockets generated in air.

Especially, $CO_2$ gas or burned CO gas ($CO+CO_2$) is effective to be jetted through a casting atmosphere adjusting nozzle 5 arranged, for example, on a rear face of the nozzle 4 jetting the molten alloy (upstream side in the rotation of the roll) as shown in FIG. 1 from a viewpoint of decreasing the number and size of the air pockets on the surface of the thin strip. This is because the gas as an air pocket is liable to be easily caught in a boundary between paddle and roll.

To decrease the air pockets on the surface of the thin strip, it is effective to apply an atmosphere gas heated to about 800° C. as a hot air to the surface of the cooling roll in the rapid solidification. This is based on the fact that the expansion of the gas caught between the paddle and the roll is small.

Example 1

A molten iron alloy having a chemical composition of Fe: 81 at %, B: 11 at % and Si: 8 at % is jetted onto a surface of a cooling roll made of copper and rotating at a high speed with a single roll type rapid cooling apparatus to produce a thin strip to prepare an amorphous alloy thin strip having a thickness of 25 μm and a width of 100 mm, which is wound in form of a coil. In this case, a surface temperature of the cooling roll is 90° C. and an atmosphere in the jetting and a surface roughness Ra of the cooling roll are changed variously as shown in Table 1.

TABLE 1

| | Conditions of producing thin strip | | | Properties of thin strip | | | Remarks |
|---|---|---|---|---|---|---|---|
| No | Atmosphere gas (vol %) | Surface roughness Ra of cooling roll (μm) | Surface temperature of cooling roll (° C.) | Number of air pocket (number/mm$^2$) | Average length of air pocket (mm) | Iron loss of core $W_{13/50}$ (W/kg) | |
| 1 | $CO_2$: 100 | 0.1 | 90 | 3 | 0.2 | 0.10 | Example |
| 2 | $CO_2$: 6, remainder: air | 0.1 | 90 | 5 | 0.3 | 0.11 | Example |
| 3 | CO combustion gas(*) | 0.1 | 90 | 4 | 0.3 | 0.11 | Example |
| 4 | $CO_2$: 100 | 0.5 | 90 | 6 | 0.4 | 0.12 | Example |
| 5 | $CO_2$: 60, remainder: air | 0.5 | 90 | 8 | 0.5 | 0.13 | Example |
| 6 | $CO_2$: 97, $H_2$: 3 | 0.1 | 90 | 5 | 0.3 | 0.11 | Example |
| 7 | $CO_2$: 30, remainder: air | 0.5 | 90 | 10 | 0.5 | 0.16 | Comparative Example |
| 8 | $CO_2$: 3, remainder: air | 0.8 | 90 | 14 | 0.6 | 0.19 | Comparative Example |
| 9 | $CO_2$: 60, remainder: air | 0.9 | 90 | 5 | 0.8 | 0.16 | Comparative Example |

TABLE 1-continued

| No | Atmosphere gas (vol %) | Surface roughness Ra of cooling roll (μm) | Surface temperature of cooling roll (° C.) | Number of air pocket (number/mm$^2$) | Average length of air pocket (mm) | Iron loss of core $W_{13/50}$ (W/kg) | Remarks |
|---|---|---|---|---|---|---|---|
| | Conditions of producing thin strip | | | Properties of thin strip | | | |
| 10 | $CO_2$: 20, remainder: air | 0.9 | 90 | 5 | 1.5 | 0.20 | Comparative Example |
| 11 | Air | 0.5 | 90 | 4 | 2.2 | 0.21 | Comparative Example |

(*)Mixed gas of CO and $CO_2$

Then, the alloy thin strip is wound on a vitreous silica bobbin having a diameter of 200 mmϕ and a width of 105 mm to prepare a toroidal core with a weight of 2 kg. Moreover, three toroidal cores are prepared from the alloy thin strip produced under the same conditions, which are subjected to an annealing at temperatures of 360° C., 380° C. and 400° C. at a state of applying a magnetic field of 1600 A/m in a nitrogen atmosphere for 1 hour, respectively.

Thereafter, a primary coil and a secondary coil are wound on the core and magnetized by alternating current under conditions of 1.3 T and 50 Hz to measure an iron loss $W_{13/50}$. In the measurement of the iron loss, shock is applied to the annealed core to sufficiently remove sticking. Hence, an iron loss value at an annealing temperature making a lowest iron loss value is adopted as an iron loss value of the alloy.

A surface of the the thus obtained thin strip at a side contacting with a cooling roll is photographed with an optical microscope at a magnification of 20 times, from which are measured the number of air pockets generated on the surface of the thin strip at an area of 10 mm square and a length of the air pocket in a circumferential direction of the roll. The measurement is performed at an interval of 20 mm in the widthwise direction of the thin strip (5 places) to calculate average values of the number of air pockets and the length in the circumferential direction of the roll at 5 places.

The above results are also shown in Table 1. As seen from these results, the alloys No. 1-6 having average number and length of air pocket in accordance with our methods are excellent in the iron loss property after annealing.

Example 2

With the same rapid cooling apparatus to produce thin strip as in Example 1, a molten iron alloy having a chemical composition shown in Table 2 is jetted onto a surface of a cooling roll and rapidly solidified to prepare an amorphous alloy thin strip having a thickness of 25 μm and a width of 100 mm, which is wound in form of a coil. As the cooling roll is used a copper roll having a surface roughness Ra of 0.3 μm and a surface temperature of 90° C., and an atmosphere gas during the jetting is $CO_2$: 60 vol % and a remainder being air.

TABLE 2

| No | Chemical composition of alloy (at %) | Iron loss of core $W_{13/50}$(W/kg) Before removal of sticking | After removal of sticking | Difference before and after removal of sticking | Magnetic flux density $B_8$ in measurement of single sheet tester (T) | Remarks |
|---|---|---|---|---|---|---|
| 1 | Fe: 78-B: 10-Si: 12 | 0.32 | 0.10 | −0.22 | 1.55 | Example |
| 2 | Fe: 80-B: 10-Si: 10 | 0.28 | 0.11 | −0.17 | 1.56 | Example |
| 3 | Fe: 82-B: 10-Si: 8 | 0.29 | 0.11 | −0.18 | 1.58 | Example |
| 4 | Fe: 83-B: 10-Si: 7 | 0.28 | 0.12 | −0.16 | 1.61 | Example |
| 5 | Fe: 80-B: 8-Si: 12 | 0.30 | 0.13 | −0.17 | 1.56 | Example |
| 6 | Fe: 79-B: 15-Si: 6 | 0.29 | 0.12 | −0.17 | 1.56 | Example |
| 7 | Fe: 80-B: 7-Si: 13 | 0.30 | 0.14 | −0.16 | 1.56 | Example |
| 8 | (Fe: 80-B: 10-Si: 10)99.8-Cr: 0.2 | 0.14 | 0.12 | −0.02 | 1.56 | Example |
| 9 | (Fe: 80-B: 10-Si: 10)99-Cr: 1 | 0.14 | 0.13 | −0.01 | 1.55 | Example |
| 10 | (Fe: 80-B: 10-Si: 10)99.8-Mn: 0.2 | 0.14 | 0.12 | −0.02 | 1.56 | Example |
| 11 | (Fe: 80-B: 10-Si: 10)98-Mn: 2 | 0.14 | 0.13 | −0.01 | 1.55 | Example |
| 12 | (Fe: 80-B: 10-Si: 10)98.5-Cr: 1-C: 0.5 | 0.14 | 0.13 | −0.01 | 1.55 | Example |
| 13 | (Fe: 80-B: 10-Si: 10)98.8-Mn: 0.2-P: 1 | 0.13 | 0.12 | −0.01 | 1.56 | Example |
| 14 | (Fe: 83-B: 10-Si: 7)99.5-Sn: 0.5 | 0.29 | 0.11 | −0.18 | 1.61 | Example |
| 15 | (Fe: 83-B: 10-Si: 7)99.5-Sb: 0.5 | 0.28 | 0.11 | −0.17 | 1.61 | Example |
| 16 | Fe: 77-B: 10-Si: 13 | 0.37 | 0.18 | −0.19 | 1.51 | Comparative Example |
| 17 | Fe: 84-B: 10-Si: 6 | 0.40 | 0.22 | −0.18 | 1.48 | Comparative Example |
| 18 | Fe: 81-B: 6-Si: 13 | 0.42 | 0.25 | −0.17 | 1.53 | Comparative Example |
| 19 | Fe: 78-B: 16-Si: 6 | 0.38 | 0.24 | −0.14 | 1.53 | Comparative Example |
| 20 | (Fe: 80-B: 10-Si: 10)98.5-Cr: 1.5 | 0.25 | 0.25 | 0 | 1.51 | Comparative Example |
| 21 | (Fe: 80-B: 10-Si: 10)97.5-Mn: 2.5 | 0.24 | 0.24 | 0 | 1.50 | Comparative Example |

As the surface property of the thus obtained thin strip, the surface roughness Ra at a side contacting with the cooling roll is 0.5 μm, and the number of air pockets is 5-6 pockets per 1 $mm^2$, and the average length of air pocket is 0.4-0.5 mm, which are within our range.

Then, toroidal cores are prepared from the alloy thin strip under the same conditions as in Example 1 and annealed to measure iron loss $W_{13/50}$ before removal of sticking and after sufficient removal of sticking.

Also, a test specimen with a length of 280 mm and a width of 100 mm is cut out from the above alloy thin strip and subjected to an annealing at any temperature of 360° C., 380° C. and 400° C. making an iron loss of a toroidal core minimum for 1 hour in a nitrogen atmosphere at a state of applying a magnetic field of 1600 A/m in a longitudinal direction, and thereafter a magnetic flux density $B_8$ (magnetic flux density at a magnetization force of 800 A/m) is measured with a single sheet tester.

The above measure results are also shown in Table 2. As seen from these results, the alloys No. 1-15 with chemical compositions satisfying our conditions are not only high in the magnetic flux density, but also excellent in iron loss property after the removal of sticking. Among them, the alloys No. 8-13 added with Cr or Mn are good in the iron loss property before the removal of sticking and can simplify the step of removing the sticking in the production of the wound iron core.

The invention claimed is:

1. An iron-based amorphous alloy thin strip having a chemical composition represented by a chemical formula of $Fe_xB_ySi_z$ (wherein x is 78-83 at %, y is 11-15 at % and z is 6-13 at %), wherein a number of recesses on a surface that contacted a cooling roll during formation of the thin strip is not more than 8 pockets/$mm^2$ and an average length of the recesses in a circumferential direction of the roll is not more than 0.5 mm.

2. The iron-based amorphous alloy thin strip according to claim 1, containing one or two of Cr: 0.2-1 at % and Mn: 0.2-2 at % in addition to the chemical composition.

3. The iron-based amorphous alloy thin strip according to claim 1, containing one or more of C: 0.2-2 at %, P: 0.2-2 at %, Sn: 0.2-1 at % and Sb: 0.2-1 at % in addition to the chemical composition.

4. The iron-based amorphous alloy thin strip according to claim 2, containing one or more of C: 0.2-2 at %, P: 0.2-2 at %, Sn: 0.2-1 at % and Sb: 0.2-1 at % in addition to the chemical composition.

5. A wound iron-core transformer comprising the iron-based amorphous alloy thin strip according to claim 1.

6. A wound iron-core transformer comprising the iron-based amorphous alloy thin strip according to claim 2.

7. A wound iron-core transformer comprising the iron-based amorphous alloy thin strip according to claim 3.

8. A wound iron-core transformer comprising the iron-based amorphous alloy thin strip according to claim 4.

* * * * *